US008672320B2

(12) United States Patent
Hasegawa et al.

(10) Patent No.: US 8,672,320 B2
(45) Date of Patent: Mar. 18, 2014

(54) RECORDING-MATERIAL TRANSPORT APPARATUS AND RECORDING-MATERIAL TRANSPORT METHOD

(75) Inventors: Yousuke Hasegawa, Tokyo (JP); Michio Tada, Kanagawa (JP); Takashi Abe, Kanagawa (JP); Yoshiyuki Takaishi, Kanagawa (JP); Yoichi Yamakawa, Kanagawa (JP); Hisakazu Onoe, Kanagawa (JP); Makio Uehara, Kanagawa (JP); Yasunobu Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 138 days.

(21) Appl. No.: 13/250,258

(22) Filed: Sep. 30, 2011

(65) Prior Publication Data

US 2012/0251211 A1 Oct. 4, 2012

(30) Foreign Application Priority Data

Mar. 28, 2011 (JP) ..... 2011-071072

(51) Int. Cl.
*B65H 9/04* (2006.01)

(52) U.S. Cl.
USPC ..... 271/243; 271/244; 271/245

(58) Field of Classification Search
USPC ..... 271/226, 243–245, 253, 254; 399/395
See application file for complete search history.

(56) References Cited

U.S. PATENT DOCUMENTS

| | | | | |
|---|---|---|---|---|
| 5,374,053 | A * | 12/1994 | Doucet et al. | 271/243 |
| 7,731,175 | B2 * | 6/2010 | Kang | 271/110 |
| 7,837,192 | B2 | 11/2010 | Müller et al. | |
| 8,272,638 | B2 * | 9/2012 | Konig | 271/202 |
| 2009/0026689 | A1 * | 1/2009 | Noguchi et al. | 271/8.1 |
| 2009/0250869 | A1 * | 10/2009 | Muller et al. | 271/245 |
| 2010/0327516 | A1 * | 12/2010 | Ishikawa et al. | 271/226 |

FOREIGN PATENT DOCUMENTS

| | | | | |
|---|---|---|---|---|
| EP | 356864 | A2 * | 3/1990 | B41J 13/32 |
| JP | A-02-070639 | | 3/1990 | |

* cited by examiner

*Primary Examiner* — Prasad Gokhale
(74) *Attorney, Agent, or Firm* — Oliff PLC

(57) ABSTRACT

A recording-material transport apparatus includes a retracting member that moves at a speed lower than a transport speed of a recording material transported from an upstream side in a transport direction, to a downstream side in the transport direction along a transport path for the recording material, and that retracts from the transport path after a leading end of the recording material contacts with the retracting member, a first transport member that transports the recording material from the upstream side in the transport direction toward the retracting member, and a second transport member that further transports the recording material in contact with the retracting member to the downstream side. After the leading end of the recording material contacts with the retracting member, without being paused, transport of the recording material with the first transport member is continued to deliver the recording material to the second transport member.

14 Claims, 6 Drawing Sheets

RECORDING-MATERIAL TRANSPORT APPARATUS AND RECORDING-MATERIAL TRANSPORT METHOD

CROSS-REFERENCE TO RELATED APPLICATIONS

This application is based on and claims priority under 35 USC 119 from Japanese Patent Application No. 2011-071072 filed Mar. 28, 2011.

BACKGROUND (i) Technical Field

The present invention relates to a recording-material transport apparatus and a recording-material transport method.

(ii) Related Art

Skew correction devices have been proposed hitherto.

SUMMARY

According to an aspect of the invention, there is provided a recording-material transport apparatus including a retracting member that moves at a speed lower than a transport speed of a recording material transported from an upstream side in a transport direction, to a downstream side in the transport direction along a transport path for the recording material, and that retracts from the transport path after a leading end of the recording material contacts with the retracting member; a first transport member that transports the recording material from the upstream side in the transport direction toward the retracting member; and a second transport member that further transports the recording material in contact with the retracting member to the downstream side. After the leading end of the recording material contacts with the retracting member, without being paused, transport of the recording material with the first transport member is continued to deliver the recording material to the second transport member.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described in detail below with reference to the attached drawings.

Figure 1:
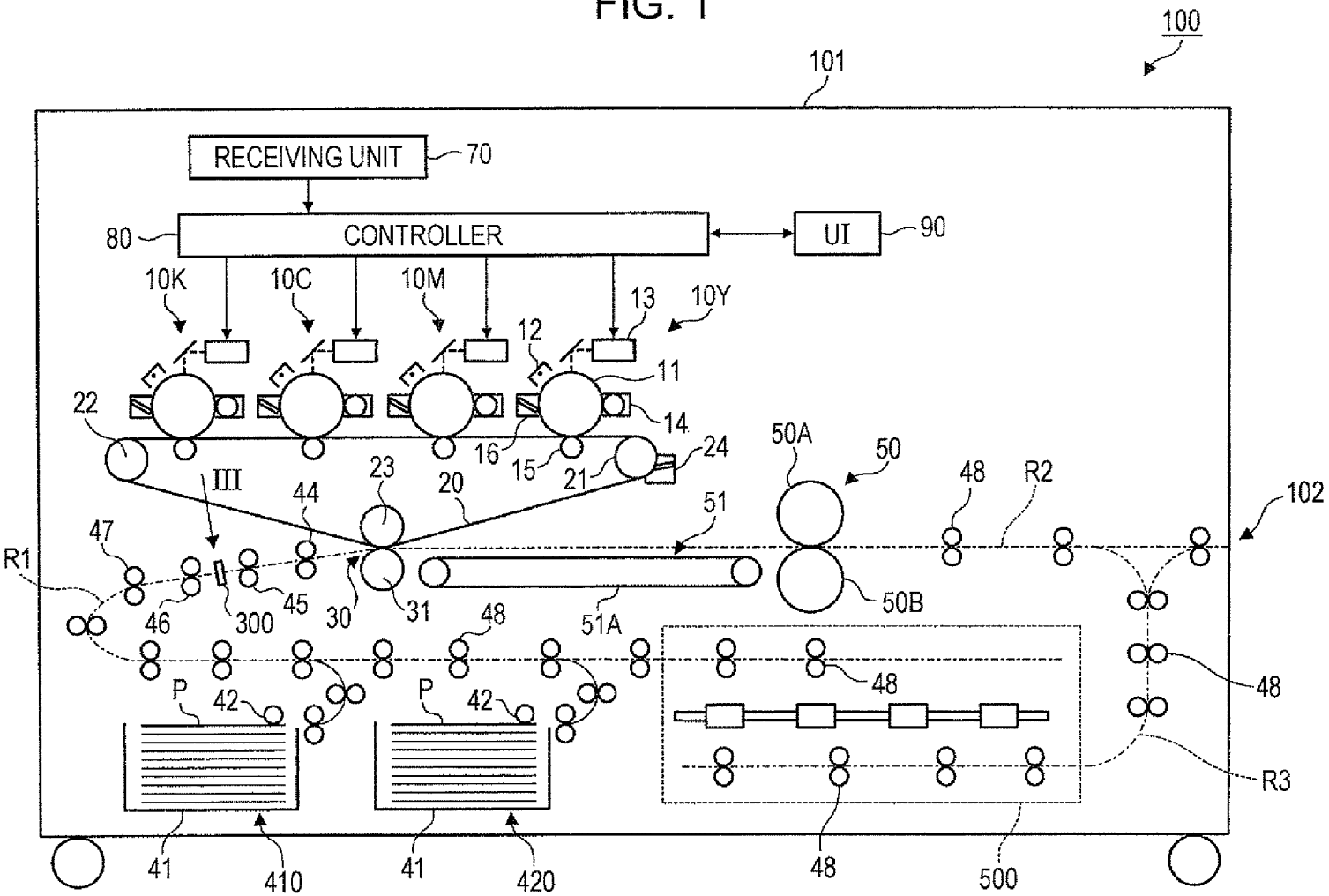
FIG. 1 is a cross-sectional front view of an image forming apparatus according to an exemplary embodiment.

FIG. 1 is a cross-sectional front view of an image forming apparatus 100 according to the exemplary embodiment. The image forming apparatus 100 illustrated in FIG. 1 is of a so-called tandem type, and includes plural image forming units 10 (10Y, 10M, 10C, and 10K) that form toner images of color components by means of electrophotography. The image forming apparatus 100 of the exemplary embodiment further includes a controller 80 that has a central processing unit (CPU), a read only memory (ROM), etc. and that controls operations of devices and sections provided in the image forming apparatus 100.

The image forming apparatus 100 further includes a user interface unit (UI) 90 formed by a display panel. The UI 90 outputs instructions received from the user to the controller 80, and presents information from the controller 80 to the user. The image forming apparatus 100 further includes an intermediate transfer belt 20 on which color component toner images formed by the image forming units 10 are sequentially transferred (first transfer) and the toner images are held, and a second transfer device 30 that transfers the toner images together from the intermediate transfer belt 20 onto a sheet P serving as an example of a recording material (second transfer).

The image forming apparatus 100 further includes a first sheet transport path R1 through which a sheet P is transported toward the second transfer device 30, a second sheet transport path R2 through which the sheet P passes after passing through the second transfer device 30, and a third sheet transport path R3 branching off from the second sheet transport path R2 on a downstream side of a fixing device 50 (described below) and extending below the first sheet transport path R1.

In the exemplary embodiment, a reverse mechanism 500 is provided to transport a sheet P from the third sheet transport path R3 to the first sheet transport path R1 and to turn the sheet P upside down. Further, in the exemplary embodiment, a housing 101 of the image forming apparatus 100 has an opening 102. Sheets P transported along the second sheet transport path R2 are output from the housing 101 through the opening 102, and are stacked on an unillustrated sheet stack portion. A handling device (not illustrated) may be provided adjacent to the housing 101, for example, to punch the sheets P output from the opening 102.

The image forming apparatus 100 further includes a first sheet supply device 410 that supplies sheets P to the first sheet transport path R1. On an upstream side of the first sheet supply device 410 in a sheet transport direction, a second sheet supply device 420 is provided to supply sheets P to the first sheet transport path R1. The first sheet supply device 410 and the second sheet supply device 420 are similar in structure, and each include a sheet storage portion 41 that stores sheets P and a feed roller 42 that feeds out and transports the sheets P from the sheet storage portion 41.

In the first sheet transport path R1 and on an upstream side of the second transfer device 30, a first transport roller 44 is provided to transport a sheet P from the first sheet transport path R1 toward the second transfer device 30. Further, a second transport roller 45 for transporting the sheet P toward the first transport roller 44, a third transport roller 46 for transporting the sheet P toward the second transport roller 45, and a fourth transport roller 47 for transporting the sheet P toward the third transport roller 46 are provided. Besides these transport rollers, plural transport rollers 48 for transporting the sheet P are provided in the first, second, and third sheet transport paths R1, R2, and R3.

In the exemplary embodiment, an abutment member 300 with which a leading end of a sheet P is to contact is provided between the second transport roller 45 and the third transport roller 46. In the exemplary embodiment, the leading end of the sheet P contacts with the abutment member 300, whereby the sheet P is corrected for skew (tilt of the sheet P from the transport direction is corrected). The abutment member 300 also serves as an example of a retracting and moving member, and retracts from the first sheet transport path R1 after correcting the sheet P for skew. In the exemplary embodiment, a fixing device 50 is provided in the second sheet transport path R2 so as to fix secondarily transferred images on the sheet P.

Between the second transfer device 30 and the fixing device 50, a transport device 51 is provided to transport the sheet P passing through the second transfer device 30 to the fixing device 50. The transport device 51 includes a circulating belt 51A that transports the sheet P thereon. The fixing device 50 includes a heating roller 50A to be heated by a built-in heater (not illustrated) and a pressing roller 50B for pressing the heating roller 50A. In the fixing device 50, the sheet P is heated and pressurized while passing between the heating roller 50A and the pressing roller 50B, so that the images on the sheet P are fixed.

Each of the image forming units 10 that form a part of an image forming section includes a rotatable photoconductor drum 11. Around the photoconductor drum 11, a charging device 12 for charging the photoconductor drum 11, an exposure device 13 for writing an electrostatic latent image on the photoconductor drum 11 by exposing the photoconductor drum 11, and a developing device 14 for developing the electrostatic latent image on the photoconductor drum 11 with toner into a visible image are arranged. Further, each of the image forming units 10 includes a first transfer device 15 that transfers color component toner images from the photoconductor drum 11 onto the intermediate transfer belt 20, and a drum cleaning device 16 that removes residual toner from the photoconductor drum 11.

The intermediate transfer belt 20 is rotatably stretched around three roll members 21 to 23. Of the three roll members 21 to 23, the roll member 22 drives the intermediate transfer belt 20, and the roll member 23 opposes the second transfer roller 31 with the intermediate transfer belt 20 being disposed therebetween. The second transfer roller 31 and the roll member 23 constitute the second transfer device 30. At a position opposing the roll member 21 with the intermediate transfer belt 20 being disposed therebetween, a belt cleaning device 24 is provided to remove residual toner from the intermediate transfer belt 20.

The image forming apparatus 100 of the exemplary embodiment forms an image not only on one surface of a sheet P supplied from the first sheet supply device 410 or the like but also on the other surface of the sheet P. More specifically, in the image forming apparatus 100, the sheet P passing through the fixing device 50 is turned upside down by the reverse mechanism 500, and the turned sheet P is transported again to the second transfer device 30, where an image is transferred on the other surface of the sheet P. After that, the sheet P passes through the fixing device 50 again, and the transferred image is fixed on the sheet P. Thus, an image is formed not only on one surface of the sheet P but also on the other surface of the sheet P.

Figure 2:
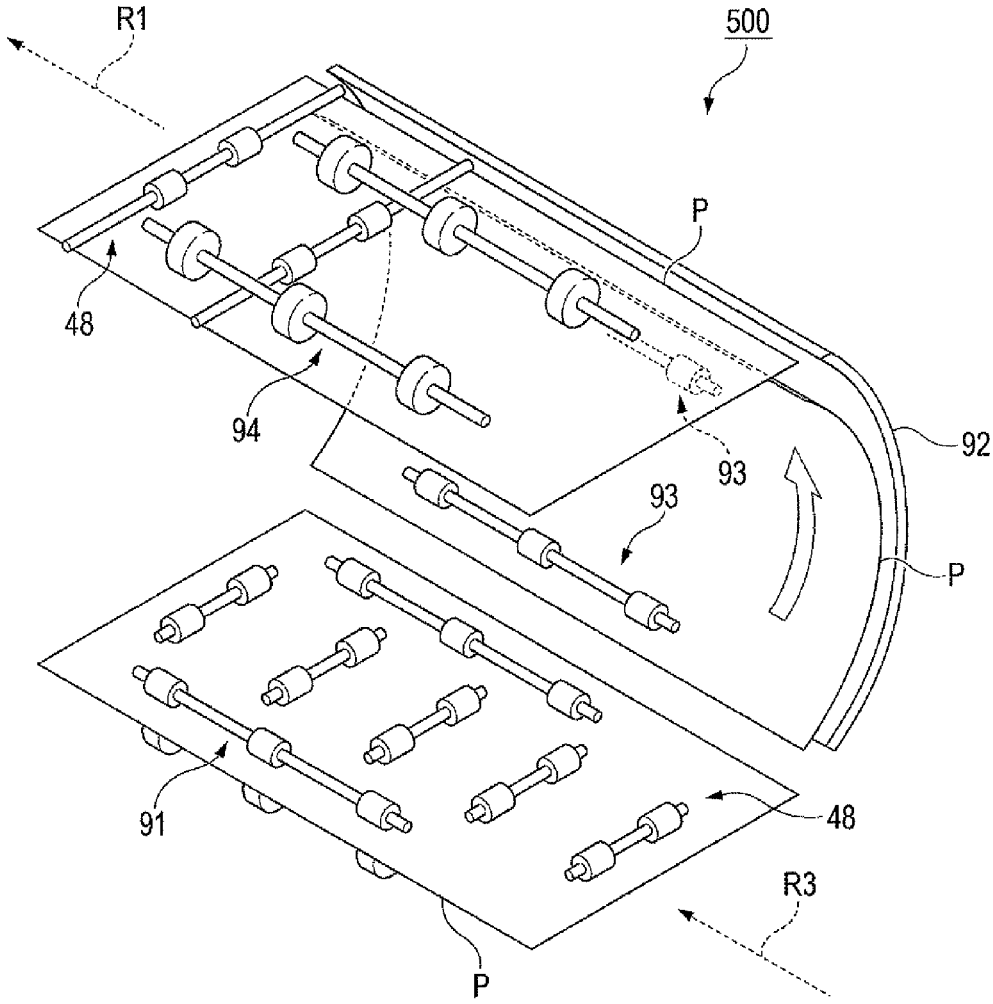
FIG. 2 illustrates a reverse mechanism.

FIG. 2 illustrates the reverse mechanism 500.

As described above, in the exemplary embodiment, plural transport rollers 48 for transporting a sheet P along the third sheet transport path R3 are provided in the third sheet transport path R3. Further, plural transport rollers 48 for transporting the sheet P along the first sheet transport path R1 are provided in the first sheet transport path R1. In the third sheet transport path R3, transport rollers 91 are also provided to transport the sheet P in a direction orthogonal to (intersecting) the transport direction of the sheet P in the third sheet transport path R3. In other words, the transport rollers 91 are provided to transport the sheet P in the lateral direction of the third sheet transport path R3.

In the exemplary embodiment, a guide member 92 is provided to guide a sheet P transported by the transport rollers 91 so that the sheet P moves upward and then further moves toward the first sheet transport path R1. Further, in the exemplary embodiment, transport rollers 93 are provided to nip the sheet P, which is guided by the guide member 92 with its leading end pointing upward, and to transport the sheet P further upward. In the first sheet transport path R1, transport rollers 94 are provided to transport the sheet P guided by the transport rollers 93 to a predetermined position in the first sheet transport path R1.

Each of the transport rollers 48 includes a pair of roll-shaped members that rotate to transport the sheet P while nipping the sheet P. FIG. 2 illustrates only one of the pair of roll-shaped members. Similarly, the transport rollers 91, the transport rollers 93, and the transport rollers 94 rotate to transport the sheet P while nipping the sheet P between a pair of roll-shaped members. In the exemplary embodiment, one of the roll-shaped members provided in each of the transport rollers 48 is separable from the other roll-shaped member. Similarly, one roll-shaped member provided in each of the transport rollers 91 and the transport rollers 94 is separable from the other roll-shaped member. Although not illustrated, a separation mechanism is provided to separate one roll-shaped member from the other roll-shaped member. The separation mechanism includes existing structures such as a motor and a cam.

When a sheet P is turned upside down by the reverse mechanism 500, it is first transported along the third sheet transport path R3 by the transport rollers 48. In this case, one roll-shaped member in each of the transport rollers 91 provided in the third sheet transport path R3 is separate from the other roll-shaped member. Next, one roll-shaped member in each of the transport rollers 48 separates from the other roll-shaped member, and the one roll-shaped member in each of the transport rollers 91 is pressed against the other roll-shaped member with the sheet P being disposed therebetween.

Subsequently, the transport rollers 91, the transport rollers 93, and the transport rollers 94 are rotated to transport the sheet P toward the first sheet transport path R1. In this case, one roll-shaped member in each of the transport rollers 48 provided in the first sheet transport path R1 is separate from the other roll-shaped member. When the sheet P is transported to the predetermined position in the first sheet transport path R1, rotations of the transport rollers 91, the transport rollers 93, and the transport rollers 94 are stopped. After that, one roll-shaped member in each of the transport rollers 94 separates from the other roll-shaped member, and the one roll-shaped member in each of the transport rollers 48 provided in the first sheet transport path R1 is pressed against the other roll-shaped member with the sheet P being disposed therebetween.

Next, the transport rollers 48 are rotated to transport the sheet P along the first sheet transport path R1. In this case, the sheet P has already been turned upside down. In the reverse mechanism 500 of the exemplary embodiment, the sheet P is turned upside down without changing places of the leading end and the trailing end of the sheet P with each other in the transport direction. On the other hand, in the reverse mechanism 500 of the exemplary embodiment, places of one side and the other side of the sheet P are changed.

Figure 3:
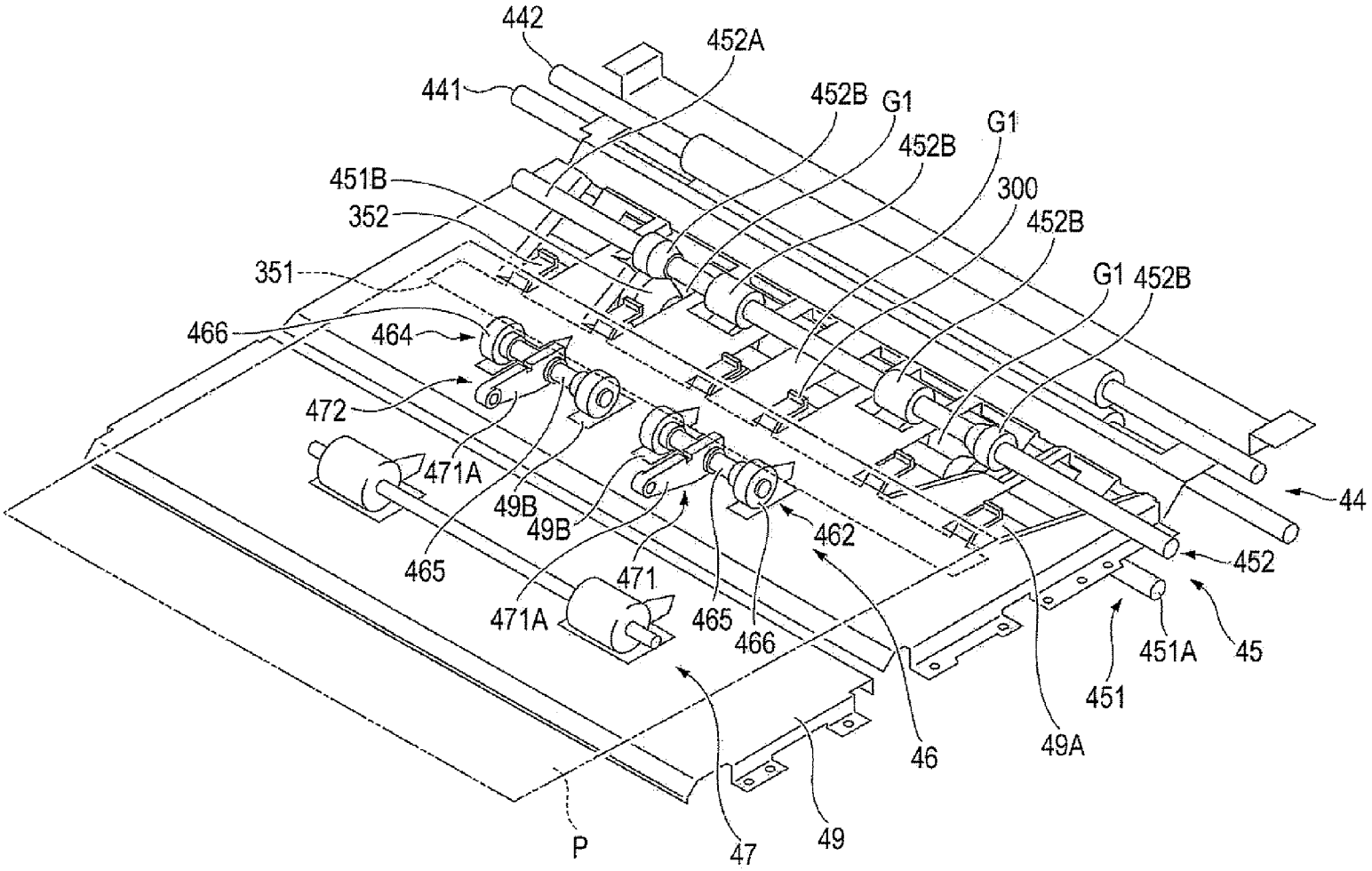
FIG. 3 is a view on arrow III of FIG. 1 illustrating a first sheet transport path.

FIG. 3 is a view on arrow III of FIG. 1 illustrating the first sheet transport path R1.

As illustrated in FIG. 3 and as described above, the first transport roller 44 for transporting the sheet P toward the second transfer device 30 (see FIG. 1) is provided in the first sheet transport path R1. Also, the second transport roller 45 for transporting the sheet P toward the first transport roller 44, the third transport roller 46 for transporting the sheet P toward the second transport roller 45, and the fourth transport roller 47 for transporting the sheet P toward the third transport roller 46 are provided in the first sheet transport path R1. In the exemplary embodiment, the abutment member 300 is provided between the second transport roller 45 and the third transport roller 46 so that the leading end of the transported sheet P contacts with the abutment member 300.

The first transport roller 44 includes a first roll-shaped member 441 and a second roll-shaped member 442 that are pressed against each other. The first roll-shaped member 441 and the second roll-shaped member 442 are rotated to transport the sheet P downstream. Similarly, the second transport roller 45 functioning as an example of a second transport member includes a first roll-shaped member 451 and a second roll-shaped member 452 that are pressed against each other. The first roll-shaped member 451 and the second roll-shaped member 452 are rotated to transport the sheet P downstream.

The first roll-shaped member 451 includes a rotation shaft 451A extending in a direction orthogonal to the transport direction of the sheet P so as to be rotated by an unillustrated motor, and plural columnar contact members 451B that corotate with the rotation shaft 451A and have outer peripheral surfaces to contact with the sheet P. The plural contact members 451B are arranged at different positions in the direction orthogonal to the transport direction of the sheet P.

The second roll-shaped member 452 also includes a rotation shaft 452A extending in the direction orthogonal to the transport direction of the sheet P, and four columnar contact members 452B that corotate with the rotation shaft 452A and have outer peripheral surfaces to contact with the sheet P. The contact members 452B serve as an example of a rotating member. The contact members 452B oppose the contact members 451B of the first roll-shaped member 451 such as to be in pressing contact therewith. The plural contact members 452B are arranged at different positions in the direction orthogonal to the transport direction of the sheet P. In the exemplary embodiment, gaps G1 are provided between the adjacent contact members 452B.

In the exemplary embodiment, a platelike support member 49 is provided to support the transported sheet P from below by contact with a lower surface of the sheet P. In the exemplary embodiment, the support member 49 has plural openings 49A, from which the abutment member 300 protrudes in the first sheet transport path R1.

The abutment member 300 is comb-shaped. More specifically, the abutment member 300 includes a platelike base portion 351 located below the support member 49 and extending in the direction orthogonal to the transport direction of the sheet P, and plural protruding pieces 352 supported by the base portion 351 and protruding into the first sheet transport path R1 through the openings 49A.

Here, the plural protruding pieces 352 are arranged at different positions in the direction orthogonal to the transport direction of the sheet P. More specifically, the abutment member 300 is not formed by a combination of plural members, but is formed by a single component. In other words, the abutment member 300 is formed by combining the base portion 351 and the protruding pieces 352 into a single component.

Although the protruding pieces 352 and the base portion 351 can be separately formed and the protruding pieces 352 can be fixed to the base portion 351, the positions of the protruding pieces 352 are apt to vary in the transport direction of the sheet P in this case. Also, the skew correction accuracy is apt to decrease. In other words, when the protruding pieces 352 are fixed to the base portion 351, they are apt to be displaced (the protruding pieces 352 are apt to deviate in the transport direction of the sheet P). In this case, for example, the protruding pieces 352 on the rear side of the image forming apparatus 100 deviate to the upstream side in the transport direction of the sheet P and the protruding pieces 352 on the front side deviate to the downstream side in the transport direction of the sheet P, so that the skew correction accuracy is apt to decrease.

The abutment member 300 is moved downstream in the transport direction of the sheet P by a moving mechanism 700 that will be described below. In the exemplary embodiment, the sheet P is transported toward the abutment member 300 by the third transport roller 46. The moving speed of the abutment member 300 and the transport speed of the sheet P with the third transport roller 46 are set such that the transport speed of the sheet P with the third transport roller 46 is higher than the moving speed of the abutment member 300. For this reason, when the sheet P is transported by the third transport roller 46, it gradually approaches the abutment member 300, and the leading end of the sheet P then contacts with the abutment member 300, whereby the sheet P is corrected for skew.

Next, the third transport roller 46 serving as an example of a first transport member will be described. The third transport roller 46 includes a first roll-shaped member (not illustrated) serving as an example of a first rotating member that performs rotation. The first roll-shaped member is located below the support member 49 and on the front side of the image forming apparatus 100. Further, the third transport roller 46 includes a second roll-shaped member 462 serving as a second rotating member. As illustrated in FIG. 3, the second roll-shaped member 462 is located above the support member 49, and is pressed against the first roll-shaped member so as to be rotated by driving force from the first roll-shaped member.

The third transport roller 46 further includes a third roll-shaped member (not illustrated) that performs rotation. The third roll-shaped member is located below the support member 49 and on the rear side of the image forming apparatus 100. The third transport roller 46 further includes a fourth roll-shaped member 464. The fourth roll-shaped member 464 is located above the support member 49 and is pressed against the third roll-shaped member so as to be rotated by driving force from the third roll-shaped member.

Each of the first to fourth roll-shaped members includes a shaft 465 extending in the direction orthogonal to the transport direction of the sheet P, and columnar rotating members 466 provided at opposite ends of the shaft 465 so as to contact with the sheet P. In the exemplary embodiment, the rotating members 466 (not illustrated) of the first roll-shaped member are in contact with the rotating members 466 of the second roll-shaped member 462.

In the exemplary embodiment, this contact is allowed by through-holes 49B provided in the support member 49. Further, in the exemplary embodiment, the rotating members 466 (not illustrated) of the third roll-shaped member are in contact with the rotating members 466 of the fourth roll-shaped member 464. This contact is allowed by through-holes 493 provided in the support member 49. In the exemplary embodiment, the first roll-shaped member, of the first roll-shaped member and the second roll-shaped member 462, is rotated by an unillustrated motor, and the third roll-shaped member, of the third roll-shaped member and the fourth roll-shaped member 464, is rotated by the unillustrated motor.

In the exemplary embodiment, a first change mechanism 471 for changing the contact pressure between the first roll-shaped member and the second roll-shaped member 462 and a second change mechanism 472 for changing the contact pressure between the third roll-shaped member and the fourth roll-shaped member 464 are provided. The first change mechanism 471 and the second change mechanism 472 are similar in structure, and each include a turn member 471A. In the exemplary embodiment, the turn member 471A is attached at one end to the shaft 465 and at the other end to an unillustrated shaft. The turn member 471A turns (pivots) on the unillustrated shaft.

Although not illustrated, each of the first change mechanism 471 and the second change mechanism 472 includes a rotation mechanism that rotates the unillustrated shaft to turn the turn member 471A. The rotation mechanism includes existing structures such as a motor and a gear. The rotation mechanism is driven to turn the turn member 471A, thereby changing the contact pressure between the first roll-shaped member and the second roll-shaped member 462 and the contact pressure between the third roll-shaped member and the fourth roll-shaped member 464.

In the exemplary embodiment, the contact pressure between the first roll-shaped member and the second roll-shaped member 462 and the contact pressure between the third roll-shaped member and the fourth roll-shaped member 464 are set so that a slip occurs between the sheet P and the third transport roller 46 when the sheet P abuts on the abutment member 300. If such a slip does not occur, the sheet P further moves toward the abutment member 300 and easily buckles.

In the exemplary embodiment, the contact pressure between the first roll-shaped member and the second roll-shaped member 462 and the contact pressure between the third roll-shaped member and the fourth roll-shaped member 464 are set so that the contact pressure between the sheet P and the abutment member 300 is higher than or equal to a predetermined contact pressure. Here, if the contact pressure between the first roll-shaped member and the second roll-shaped member 462 and the contact pressure between the third roll-shaped member and the fourth roll-shaped member 464 are low, the contact pressure between the sheet P and the abutment member 300 is also low, and therefore, skew correction is difficult.

The contact pressure between the first roll-shaped member and the second roll-shaped member 462 and the contact pressure between the third roll-shaped member and the fourth roll-shaped member 464 may be changed according to the type of the sheet P to be transported. For example, when a sheet P that has high rigidity and is apt to buckle is transported, the contact pressure between the first roll-shaped member and the second roll-shaped member 462 and the contact pressure between the third roll-shaped member and the fourth roll-shaped member 464 may be set to be low. In this case, a slip easily occurs between the sheet P and the third transport roller 46, and the sheet P rarely buckles.

In contrast, when a sheet P that is apt to loop, such as thin paper, is transported, load acting from the abutment member 300 on the sheet P is removed, and the contact pressure between the sheet P and the abutment member 300 is apt to decrease. For this reason, when such a sheet P is transported, the contact pressure between the first roll-shaped member and the second roll-shaped member 462 and the contact pressure between the third roll-shaped member and the fourth roll-shaped member 464 may be increased. In this case, a slip does not easily occur between the sheet P and the third transport roller 46, and the contact pressure between the sheet P and the abutment member 300 easily increases.

To change the contact pressures, first, the controller 80 serving as an example of an acquisition unit acquires information about the type of the sheet P (information about the sheet P). Then, the controller 80 also functioning as a change member changes the contact pressures on the basis of the acquired information. The controller 80 acquires information about the type of the sheet P on the basis of information input through the user interface unit 90 (see FIG. 1) by the user and information received by a receiving unit 70.

The contact pressure between the first roll-shaped member and the second roll-shaped member 462 may be different from the contact pressure between the third roll-shaped member and the fourth roll-shaped member 464. To correct the sheet P for skew, the sheet P is turned so that a leading side of the sheet P retreats. In such a case, if the contact pressure between the first roll-shaped member and the second roll-shaped member 462 is equal to the contact pressure between the third roll-shaped member and the fourth roll-shaped member 464, it may be difficult to turn the sheet P.

Accordingly, the contact pressure between a pair of rollers in contact with the leading side, of one pair of rollers including the first roll-shaped member and the second roll-shaped member 462 and the other pair of rollers including the third roll-shaped member and the fourth roll-shaped member 464, can be lower than the contact pressure between a pair of rollers in contact with the following side. In this case, the leading side of the sheet P easily retreats, and the sheet P turns more smoothly.

It can be detected which side of the sheet P leads (which of one side and the other side of the sheet P leads), by detecting the leading end of the sheet P with two sensors arranged at different positions in the direction orthogonal to the transport direction of the sheet P.

Figure 4:
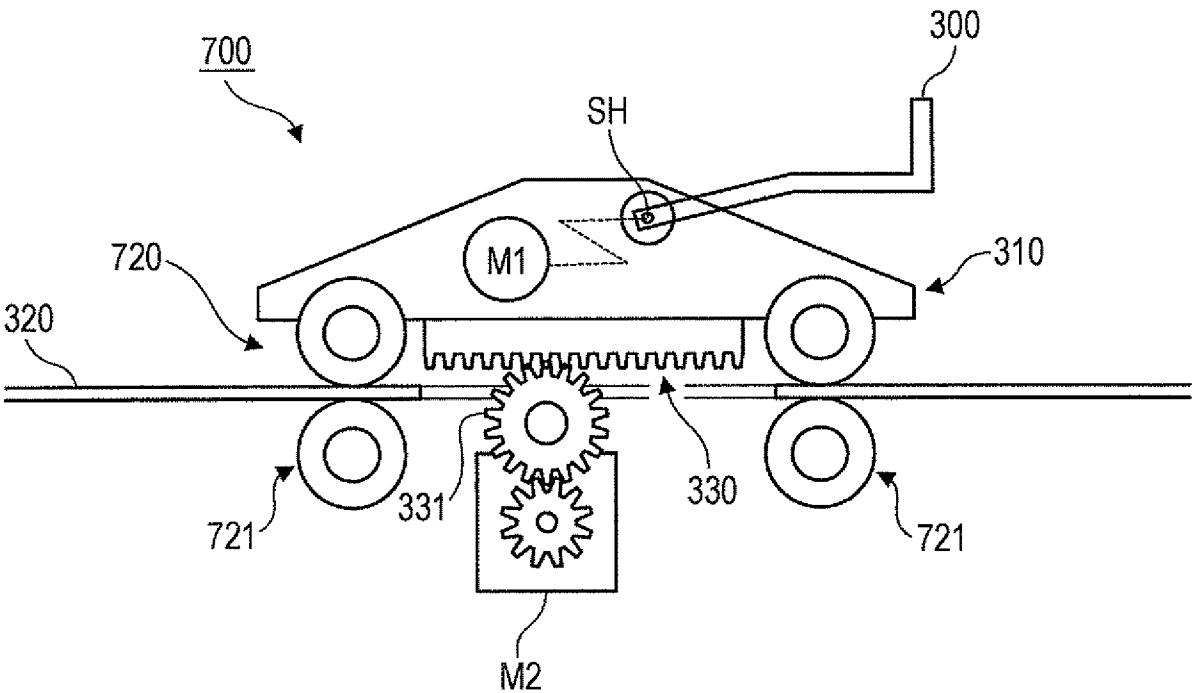
FIG. 4 illustrates a moving mechanism that moves an abutment member.

FIG. 4 illustrates the moving mechanism 700 for moving the abutment member 300. In the exemplary embodiment, the moving mechanism 700 moves the abutment member 300 in the transport direction of the sheet P (along the first sheet transport path R1). The moving mechanism 700 includes a carriage 310 that is provided below the support member 49 (see FIG. 3) and that reciprocates in the transport direction of the sheet P. The carriage 310 is supported from below by a support plate 320.

The carriage 310 is provided with a guide mechanism 720 that guides and moves the carriage 310 along the support plate 320. The guide mechanism 720 includes a pair of rotatable roll-shaped members 721. One of the pair of roll-shaped members 721 is in contact with one surface of the support plate 320 and the other roll-shaped member 721 is in contact with the other surface of the support plate 320 so as to guide the moving carriage 310. The pair of roll-shaped members 721 are provided at two positions on the upstream and downstream sides in the moving direction of the carriage 310.

The carriage 310 includes a rotatable shaft SH that supports one end of the abutment member 300 (base portion 351 (see FIG. 3)). The abutment member 300 turns (pivots) on the shaft SH. The carriage 310 further includes a motor M1 that rotates the shaft SH. At a portion of the carriage 310 opposing the support plate 320, a rack gear 330 is provided. In the exemplary embodiment, the rack gear 330 is meshed with a pinion gear 331 that is rotated by a motor M2.

Figure 5A:
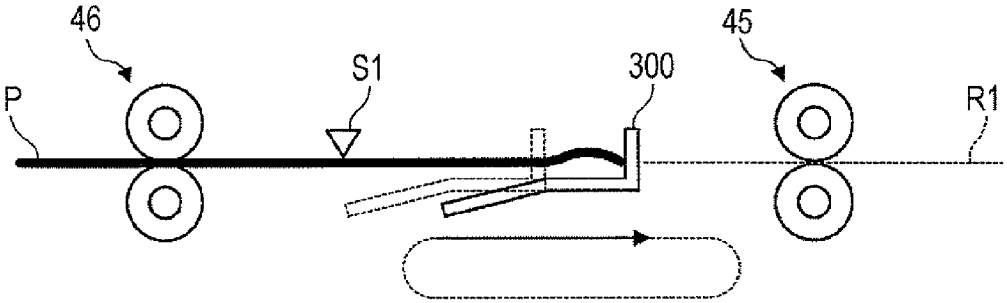
FIGS. 5A to 5C illustrate motions of the abutment member.
Figure 5B:
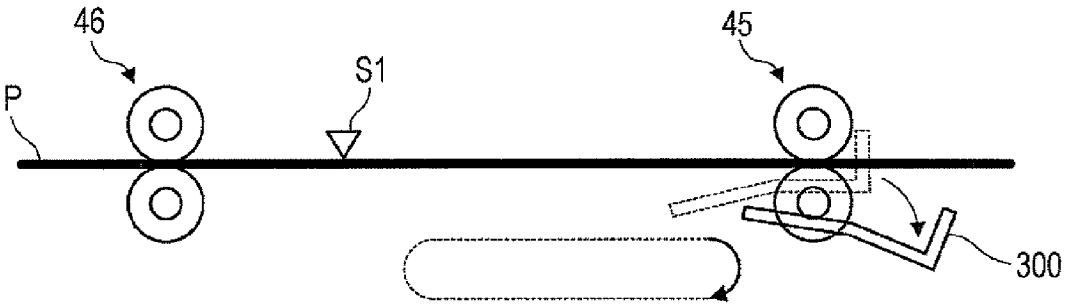
Figure 5C:
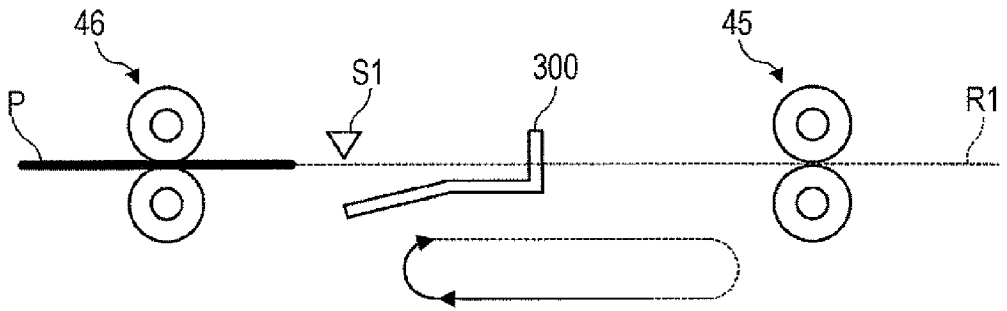

FIGS. 5A to 5C illustrate the motions of the abutment member 300. The motions of the abutment member 300 will be described also with reference to FIG. 4.

Although not described above, in the exemplary embodiment, as illustrated in FIG. 5A, a detection sensor S1 for detecting a leading end of a sheet P is provided between the second transport roller 45 and the third transport roller 46 and on the upstream side of the abutment member 300. In the exemplary embodiment, when the sheet P is detected by the detection sensor S1, the motor M2 is driven to start movement of the carriage 310 to the downstream side in the transport direction of the sheet P. The moving speed of the carriage 310 is lower than the transport speed of the sheet P with the third transport roller 46.

After starting to move downstream, the carriage 310 moves at a constant speed. Correspondingly, the abutment member 300 moves at a constant speed. In the exemplary embodiment, the leading end of the sheet P contacts with the abutment member 300 that is moving at a constant speed, and transport of the sheet P is continued in this state. Thus, the leading end of the sheet P is aligned with the direction orthogonal to the transport direction of the sheet P, and the sheet P is corrected for skew.

After that, as illustrated in FIG. 5B, when the abutment member 300 reaches the second transport roller 45, the sheet P is nipped by the second transport roller 45, and the second transport roller 45 starts to transport the sheet P. The sheet P is further transported by the first transport roller 44 (see FIG. 1), and is supplied to the second transfer device 30, where a toner image is formed on the sheet P. A time at which the sheet P is supplied to the second transfer device 30 is adjusted by the first transport roller 44. More specifically, the supply time of the sheet P to the second transfer device 30 is adjusted by changing (increasing or decreasing) the rotation speed of the first transport roller 44. In other words, in the exemplary embodiment, the supply time of the sheet P to the second transfer device 30 is adjusted in a state in which the first transport roller 44 continues rotation.

The motions of the abutment member 300 will be described further.

After the second transport roller 45 holds the sheet P and starts to transport the sheet P, driving of the motor M1 starts. Thus, as illustrated in FIG. 5B, the abutment member 300 turns downward to a position out of the first sheet transport path R1.

In the exemplary embodiment, as illustrated in FIG. 5B, the abutment member 300 moves to a position beyond the second transport roller 45, and then turns downward (retracts from the first sheet transport path R1). If the abutment member 300 turns downward before the second transport roller 45 starts to transport the sheet P, the abutment member 300 separates from the leading end of the sheet P before the second transport roller 45 nips the sheet P. In this case, the sheet P may skew again before the leading end of the sheet P reaches the second transport roller 45. For this reason, in the exemplary embodiment, the abutment member 300 is moved to the position beyond the second transport roller 45 so as to prevent the abutment member 300 from separating from the leading end of the sheet P before the leading end of the sheet P reaches the second transport roller 45.

In the exemplary embodiment, after the abutment member 300 turns downward, the second motor M2 is reversed to move the carriage 310 upstream. With this movement of the carriage 310, the abutment member 300 also moves upstream, as illustrated in FIG. 5C. This allows a new transported sheet P to be corrected for skew. In the exemplary embodiment, the motor M1 is reversed while the carriage 310 is moving upstream, and the abutment member 300 protrudes in the first sheet transport path R1 while the carriage 310 is moving upstream.

While the abutment member 300 is turned by the motor M1 in the exemplary embodiment, a guide rail (not illustrated) for guiding the abutment member 300 may be provided on a side of the first sheet transport path R1 so as to turn the abutment member 300. In the second transport roller 45 of the exemplary embodiment, the gaps G1 are provided between the adjacent contact members 452B, as illustrated in FIG. 3. After reaching the second transport roller 45, the abutment member 300 passes through the gaps G1 provided in the second transport roller 45 and then moves to the position beyond the second transport roller 45.

FIGS. 6A to 6D explain the moving speed of the abutment member 300 and the transport speed of the sheet P.

In the exemplary embodiment, as illustrated in FIG. 6A, the transport speed of the sheet P with the third transport roller 46 is set at V1 (mm/s). In the exemplary embodiment, when the leading end of the sheet P is detected by the sensor S1, the stopped abutment member 300 starts movement, accelerates from a speed of 0 (mm/s) to a speed V3 (mm/s), and moves at the speed V3, as illustrated in FIG. 6B. The speed V3 is lower than the above-described speed V1. For this reason, the sheet P contacts with the abutment member 300 and is thereby corrected for skew.

Figure 6:
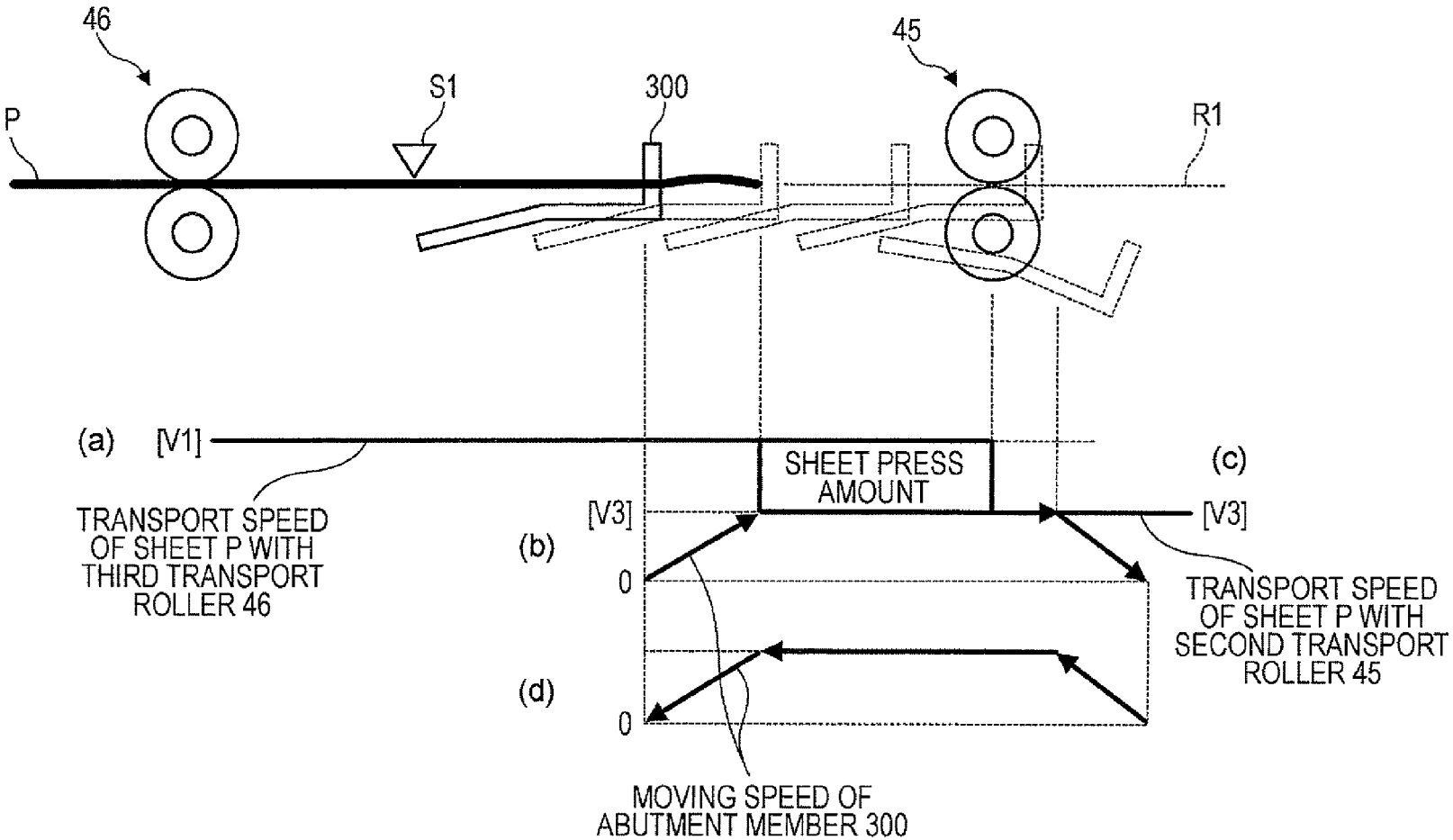
FIGS. 6A to 6D illustrate a moving speed of the abutment member and a transport speed of a sheet.

After that, in the exemplary embodiment, as illustrated in FIG. 6(*c*), the second transport roller 45 starts to transport the sheet P. In the exemplary embodiment, the moving speed of the abutment member 300 is equal to the transport speed of the sheet P with the second transport roller 45 (moving speed (peripheral speed) of an outer peripheral surface of the second transport roller 45). That is, the transport speed of the sheet P with the second transport roller 45 is equal to the speed V3 (mm/s). Subsequently, in the exemplary embodiment, the abutment member 300 is decelerated and temporarily stopped, as illustrated in FIG. 6B. Then, as illustrated in FIG. 6D, the abutment member 300 moves upstream in the transport direction of the sheet P, and is then stopped at a predetermined position on the upstream side.

In the exemplary embodiment, as described above, the moving speed of the abutment member 300 is equal to the transport speed of the sheet P with the second transport roller 45. If the transport speed of the sheet P with the second transport roller 45 is lower than the moving speed of the abutment member 300, the sheet P contacts with the second transport roller 45, and the leading end (leading edge) of the sheet P may be aligned with the second transport roller 45.

In other words, when the sheet P contacts with the second transport roller 45 after being corrected for skew by the abutment member 300, the sheet P may skew again. For this reason, in the exemplary embodiment, the transport speed of the sheet P with the second transport roller 45 is equal to the moving speed of the abutment member 300. The transport speed of the sheet P with the second transport roller 45 may be higher than the moving speed of the abutment member 300.

The sheet P can be corrected for skew by being brought into contact with the stopped abutment member 300. In this case, however, in order to prevent the sheet P from being damaged by contact with the abutment member 300, for example, it is necessary to considerably decrease the transport speed of the sheet P or to pause transport of the sheet P. In this case, the number of sheets P that can be transported per unit time decreases, and productivity is apt to decrease. In contrast, an the exemplary embodiment, since the abutment member 300 moves with the sheet P, skew correction is performed without pausing transport of the sheet P. This makes productivity higher than in the case in which the abutment member 300 is stopped.

For example, it is conceivable to pause transport of the sheet P with the third transport roller 46 and movement of the abutment member 300 after the sheet P contacts with the abutment member 300 and to restart transport and movement in correspondence with a time at which a toner image moves to the second transfer device 30. In this case, however, productivity is also apt to decrease.

In the exemplary embodiment, even after the sheet P contacts with the abutment member 300, transport of the sheet P with the third transport roller 46 continues without being paused, and the sheet P is delivered to the rotating second transport roller 45. Further, in the exemplary embodiment, even after the sheet P contacts with the abutment member 300, the abutment member 300 does not stop, but reaches the second transport roller 45. For this reason, in the exemplary embodiment, productivity is higher than in the case in which transport of the sheet P with the third transport roller 46 and movement of the abutment member 300 are paused.

While the abutment member 300 is mounted on the carriage 310 that reciprocates along the first sheet transport path R1 in the exemplary embodiment, it may be mounted on an outer peripheral surface of a looped belt member that circulates. In this case, the abutment member 300 is moved downstream and moved upstream (returned) only by driving a motor for driving the belt member in one direction. When the belt is thus used, two paths, that is, a forward path through which the belt moves downstream and a return path through which the belt moves upstream are needed. In this case, the size of the apparatus is apt to increase. In contrast, since the carriage 310 reciprocates along one path in the exemplary embodiment, the size of the apparatus rarely increases.

While the transport speed of the sheet P with the third transport roller 46 is constant in the above exemplary embodiment, it may be changed according to the type of the sheet P. For example, when a sheet P that may be damaged by contact with the abutment member 300 is transported, the transport speed of the sheet P with the third transport roller 46 may be decreased. In contrast, when a sheet P having high rigidity contacts with the abutment member 300, it sometimes vibrates and is not easily corrected for skew. When such a sheet P is used, the transport speed may be decreased. In contrast, when the transport speed of the sheet P is increased, the number of sheets P that can be transported per unit time is increased, and this enhances productivity.

To change the transport speed, first, the controller 80 serving as an example of the acquisition unit acquires information about the type of the sheet P (information about the sheet P). After that, the controller 80 also functioning as the change unit changes the transport speed on the basis of the acquired information. The controller 80 acquires information about the type of the sheet P on the basis of information input through the user interface unit 90 (see FIG. 1) by the user and information received by the receiving unit 70.

While the first roll-shaped member and the second roll-shaped member 462 (see FIG. 3) are constantly in contact with each other and the third roll-shaped member and the fourth roll-shaped member 464 are constantly in contact with each other in the above exemplary embodiment, the first roll-shaped member and the second roll-shaped member 462 may be separated and the third roll-shaped member and the fourth roll-shaped member 464 may be separated after the second transport roller 45 starts to transport the sheet P (after the second transport roller nips the sheet P).

In the exemplary embodiment, the transport speed of the sheet P with the third transport roller 46 is higher than the transport speed with the second transport roller 45 (see FIG. 6). If the third transport roller 46 continues to transport the sheet P even after the second transport roller 46 starts to transport the sheet P, the sheet P may be curved. Accordingly, when the first roll-shaped member and the second roll-shaped member 462 are separated and the third roll-shaped member and the fourth roll-shaped member 464 are separated, as described above, the occurrence of such a curve is suppressed.

A sensor for detecting a side of the sheet P may be provided. The first transport roller 44 (see FIG. 1) that nips the sheet P may be moved in the direction orthogonal to the transport direction on the basis of a detection result from the sensor. In this case, the sheet P, which is transported while deviating in the direction orthogonal to the transport direction of the sheet P, can be returned to its original position, and deviation of the position of an image formed on the sheet P from its original position is suppressed.

In such a structure in which the first transport roller 44 moves, if one roll-shaped member in the second transport roller 45 is in contact with the other roll-shaped member, the sheet P may be damaged because the sheet P does not move. For this reason, in such a structure, one roll-shaped member in the second transport roller 45 may be separated from the other roll-shaped member after the sheet P is held (nipped) by the first transport roller 44. When a rear end of the sheet P held by the first transport roller 44 reaches the third transport roller 46, the roll-shaped members may also be separated in the third transport roller 46.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-material transport apparatus comprising:

a retracting member that moves at a speed lower than a transport speed of a recording material transported from an upstream side in a transport direction to a downstream side in the transport direction along a transport path for the recording material, and that retracts from the transport path after a leading end of the recording material contacts with the retracting member;

a first transport member that transports the recording material from the upstream side in the transport direction toward the retracting member; and a second transport member that further transports the recording material in contact with the retracting member to the downstream side, wherein, after the leading end of the recording material contacts the retracting member, without being paused, transport of the recording material with the first transport member is continued to deliver the recording material to the second transport member, and wherein the retracting member retracts from the transport path after reaching a position beyond the second transport member in the transport direction, the position being on a downstream side of the second transport member.

2. The recording-material transport apparatus according to claim 1, wherein a transport speed of the recording material with the second transport member is set to be equal to or higher than a moving speed at which the retracting member reaches the second transport member.

3. The recording-material transport apparatus according to claim 2, further comprising a controller serving as:

an acquisition unit that acquires information about the recording material; and a change unit that changes a transport speed of the recording material with the first transport member on the basis of the information acquired by the acquisition unit.

4. The recording-material transport apparatus according to claim 2, wherein the first transport member transports the recording material by using at least a first rotating member that rotates and a second rotating member that is in contact with the first rotating member and is rotated by driving force from the first rotating member, and wherein the recording-material transport apparatus further includes a controller serving as:

an acquisition unit that acquires information about the recording material; and a change unit that changes a contact pressure between the first rotating member and the second rotating member on the basis of the information acquired by the acquisition unit.

5. The recording-material transport apparatus according to claim 1, further comprising a controller serving as:

an acquisition unit that acquires information about the recording material; and a change unit that changes a transport speed of the recording material with the first transport member on the basis of the information acquired by the acquisition unit.

6. The recording-material transport apparatus according to claim 1, wherein the first transport member transports the recording material by using at least a first rotating member that rotates and a second rotating member that is in contact with the first rotating member and is rotated by driving force from the first rotating member, and wherein the recording-material transport apparatus further includes a controller serving as:

an acquisition unit that acquires information about the recording material; and a change unit that changes a contact pressure between the first rotating member and the second rotating member on the basis of the information acquired by the acquisition unit.

7. A recording-material transport apparatus comprising:

a first transport member that transports a recording material;

a second transport member that is located downstream of the first transport member in a transport direction of the recording material and that transports the recording material; and a moving member that moves toward the second transport member while a leading end of the recording material transported by the first transport member is in contact with the moving member, the moving member reaching the second transport member without stopping during the movement, wherein the moving member retracts from a transport path of the recording material after reaching a position beyond the second transport member in the transport direction, the position being on a downstream side of the second transport member.

8. The recording-material transport apparatus according to claim 7, wherein the second transport member transports the recording material by using a plurality of rotating portions arranged at different positions in a direction intersecting the transport direction of the recording material, and wherein the moving member moves to the position beyond the second transport member by passing through a gap provided between adjacent rotating portions.

9. The recording-material transport apparatus according to claim 8, wherein the moving member is attached to a moving body that reciprocates along the transport path of the recording material, and is moved by the moving body.

10. The recording-material transport apparatus according to claim 8, further comprising:

an image forming unit that forms an image on the recording material after the leading end of the recording material contacts the moving member.

11. The recording-material transport apparatus according to claim 7, wherein the moving member is attached to a moving body that reciprocates along the transport path of the recording material, and is moved by the moving body.

12. The recording-material transport apparatus according to claim 11, further comprising:

an image forming unit that forms an image on the recording material after the leading end of the recording material contacts the moving member.

13. The recording-material transport apparatus according to claim 7, further comprising:

an image forming unit that forms an image on the recording material after the leading end of the recording material contacts the moving member.

14. A recording-material transport method comprising:

transporting a recording material with a first transport member;

moving the recording material toward a second transport member with a moving member, a leading end of the recording material transported by the first transport member being in contact with the moving member and the recording material reaching the second transport member without stopping during the movement; and transporting the recording material with the second transport member, the second transport member being located downstream of the first transport member in a transport direction of the recording material, wherein the moving member retracts from a transport path of the recording material after reaching a position beyond the second transport member in the transport direction, the position being on a downstream side of the second transport member.

* * * * *